US006056581A

United States Patent [19]

Rothenberger

[11] Patent Number: 6,056,581

[45] Date of Patent: May 2, 2000

[54] LATCH DETENT/STOP MECHANISM FOR ELECTRICAL CONNECTORS

[75] Inventor: Richard Ellis Rothenberger, Harrisburg, Pa.

[73] Assignee: The Whitaker Corporation, Wilmington, Del.

[21] Appl. No.: 08/898,060

[22] Filed: Jul. 22, 1997

Related U.S. Application Data

[63] Continuation of application No. 08/557,256, Nov. 14, 1995, abandoned.

[51] Int. Cl.[7] ..... H01R 13/64

[52] U.S. Cl. ..... 439/372; 439/953

[58] Field of Search ..... 439/360, 362–364, 439/372, 953

[56] References Cited

U.S. PATENT DOCUMENTS

| | | | |
|---|---|---|---|
| 3,594,698 | 7/1971 | Anhalt | 439/953 X |
| 3,790,915 | 2/1974 | Dugan et al. . | |
| 3,796,985 | 3/1974 | Weber . | |
| 3,950,058 | 4/1976 | Cronin . | |
| 3,977,749 | 8/1976 | Langenbach . | |
| 4,026,623 | 5/1977 | Goodman et al. . | |
| 4,109,987 | 8/1978 | Bourdon . | |
| 4,203,641 | 5/1980 | Siebens . | |
| 4,869,680 | 9/1989 | Yamamoto et al. | 439/327 |
| 5,073,127 | 12/1991 | Daly et al. | 439/473 |
| 5,105,095 | 4/1992 | Rudy, Jr. et al. | 307/17 |
| 5,190,465 | 3/1993 | Davidge et al. | 439/304 |
| 5,308,252 | 5/1994 | Mroczkowski et al. | 439/66 |
| 5,310,352 | 5/1994 | Mroczkowski et al. | 439/76 |
| 5,340,255 | 8/1994 | Duran | 411/373 |
| 5,368,496 | 11/1994 | Ranalletta et al. | 439/261 |
| 5,554,045 | 9/1996 | Bethurum | 439/372 |

OTHER PUBLICATIONS

U.S. Patent Application Serial No. 08/332,975 filed Nov. 1, 1994 (Abstract and Drawings only included).

U.S. Patent Application Serial No. 08/363,174 filed Dec. 23, 1994 (Abstract and Drawings only included).

*Primary Examiner*—Khiem Nguyen

[57] ABSTRACT

A locking mechanism (10) for use with an electrical connector assembly (80). The locking mechanism (10) includes a latch support (60) having a D-slot washer (52) therein which is installed on a rotatable shaft (20). The rotatable shaft (20) is operable to engage a camming plate on a further electrical connector and thereby draw the assembly (80) into electrical engagement therewith. A stop flange (52*b*) of D-slot washer (52) is operable to limit the amount of rotational movement of the shaft (20) thereby preventing over-travel of the shaft. Additionally, the locking mechanism includes a ball plunger (56) for interfacing with the stop flange (52*b*) thereby providing a detent for the D-slot washer (52) and shaft (20). Over torque and over-travel of the shaft (20) are prevented, and the ball plunger (56) prevents inadvertent rotation of the shaft (20).

40 Claims, 4 Drawing Sheets

LATCH DETENT/STOP MECHANISM FOR ELECTRICAL CONNECTORS

This application is a Continuation of application Ser. No. 08/557,256 filed Nov. 14, 1995 now abandoned.

The present invention relates to an electrical connector for electrical connection to a substrate, for example, a substrate comprising an interposer electrical connector. More particularly, the present invention relates to an electrical connector having a rotatable locking shaft for locking the electrical connector to the substrate, and whereby the shaft includes a latch detent stop mechanism for stabilizing the shaft in the unlocked position.

BACKGROUND OF THE INVENTION

U.S. Pat. No. 5,310,352, which is hereby incorporated by reference in its entirety, discloses an electrical connector for connection to a substrate comprising an interposer connector. The known electrical connector includes a rotatable shaft for locking the electrical connector to a substrate. The shaft includes outwardly extending cam posts which slidingly interface with a camming plate on the substrate. As the shaft is rotated, the camming posts slidingly engage cam surfaces on the camming plate, thereby drawing the electrical connector and the substrate together. Electrical connector subassemblies within the electrical connector housing are provided with receptacle contacts for receiving pin contacts. The known electrical connector further includes conductive faces for engaging conductive contacts formed on the interposer, thereby making electrical interconnections. The shaft is axially spring biased by Belleville springs for allowing the shaft to be axially returned to its unlatched state. Additionally, U.S. Pat. No. 5,308,252, which is hereby incorporated by reference in its entirety, discloses an interposer connector and contact element therefor which is used as the interposer of U.S. Pat. No. 5,310,352.

U.S. Pat. No. 4,869,680 discloses a rotatable shaft for joining a printed circuit board to an electrical connector. The rotatable shafts disclosed therein include spring biased balls disposed within bores which have been made in the shafts in a direction transverse to the longitudinal axis of the shafts. One set of balls is used to biasingly depress the printed circuit board against a metal frame of the housing for heat transfer purposes, and a second set of balls is used as a detent mechanism for maintaining the shaft in its locked, fully advanced position. However, this known connector uses many parts, requires bores in the shaft, and assembling the springs and balls into the bores is expensive and time consuming.

U.S. Pat. No. 4,026,623 includes a rotatable shaft for joining an electrical connector to an electrical component. Attached to the shaft is a camming member which cams a portion of the electrical connector housing so that electrical contacts are forced into electrical contact. No latch detent mechanism is disclosed therein so that the shaft may be unintentionally rotated from its unlocked position by vibration acting on the connector.

In order to overcome the deficiencies of the prior connectors, the present invention provides an electrical connector with a rotatable shaft therein, which shaft is connected to a detent/stop locking mechanism for retaining the shaft in a fully retracted, unmated condition. The electrical connector of the present invention, however, minimizes the number of parts required, is easy to manufacture, and is inexpensive to assemble. Moreover, the detent mechanism provides a reliable and robust means of latching the shaft in place in its retracted position. Additionally, stop edges are adapted to prevent over travel or over torquing of the shaft during application of a torque to the shaft.

DETAILED DESCRIPTION OF THE INVENTION

Figure 1:
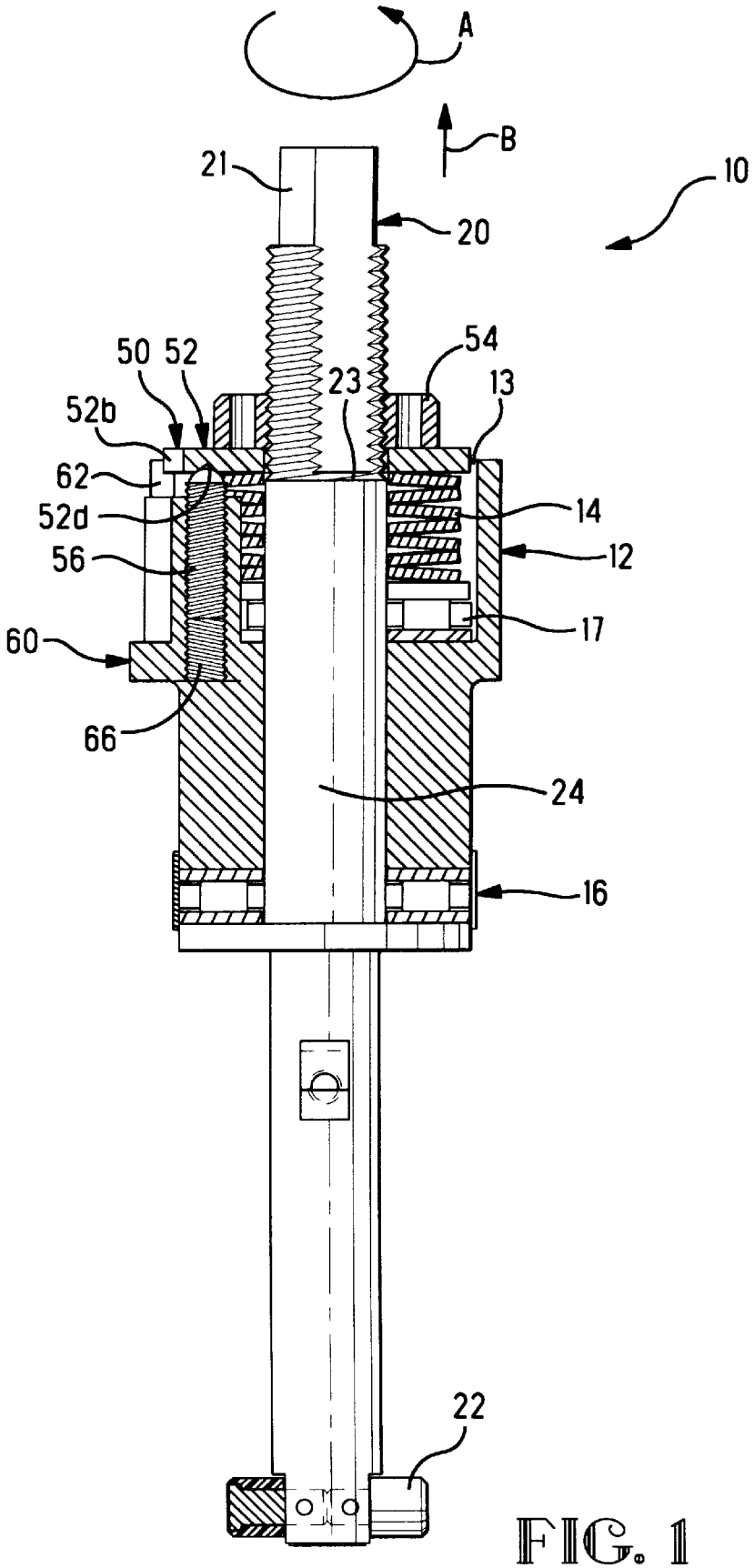
FIG. 1 shows an elevational view of the latch detent/stop mechanism according to the present invention installed on a rotatable shaft.

FIG. 1 shows an elevational view, in partial cross section, of the latch detent/stop mechanism 10 according to the present invention. The detent/stop mechanism 10 includes a rotatable shaft 20, a mechanism 50, and a latch support 60. The detent/stop mechanism 10 further includes a stationary housing 12 having a cavity 13, and a Belleville 14 spring within the cavity. A bearing support structure 16 rotatably attaches the shaft 20 to the stationary housing 12, thereby providing support and allowing relative rotational movement between stationary housing 12 and shaft 20 as shaft 20 is rotated. Shaft 20 includes a threaded head section with key flats 21 for receiving a key member 90 therearound (see FIG. 6), which key imparts torque to the shaft 20. Roller pins 22 are located at an opposite end of the shaft 20 for rolling on a cam surface plate of an electrical substrate, such as disclosed in U.S. Pat. No. 5,310,352, which is incorporated by reference in its entirety. Shaft 20 further includes a transition section 23 comprising an end to the threaded section of the shaft and a transition between the key flats 21 and a circular cross section of the shaft 24. Arrow A indicates the direction of rotation for unlocking the shaft, as will be further described below. Mechanism 50 includes an actuation member preferably comprising a D-slot washer 52 with a stop flange **52*b* protruding therefrom over a ball plunger 56. Retaining nut 54 is threaded onto shaft 20 and engages the D-slot washer 52 for retaining the washer in place between the spring 14 and nut 54. The nut 54 also supports the shaft 20 as the Belleville spring 14 presses against D-slot washer 52, which in turn presses against the nut 54, thereby biasingly supporting shaft 20. As the shaft is rotated in the direction of arrow A, the shaft will move upwardly in the direction of arrow B as rollers 22 will move upwardly as they rotatable engage a camming plate in the electrical substrate, as is disclosed in U.S. Pat. No. 5,310,352 which is incorporated by reference. Belleville spring bearing assembly 17 is disposed below the Belleville spring 14, thereby relieving the Belleville spring of stress during rotation of shaft 20**.

Ball plunger 56, which has an outer threaded shell, is preferably installed in a threaded plunger chamber 66 of latch support 60. Latch support 60 further includes a pair of stop edges 62 (see FIGS. 2–3) for abutting engagement with stop edges 52*e* and 52*f* of stop flange 52*b* of D-slot washer 52. Edge 52*e* is adapted to abuttingly engage a stop edge 62 as shaft 20 is rotated to its unlatched, fully retracted position. Edge 52*f* is adapted to abuttingly engage an opposing stop edge 62 as shaft 20 is rotated to its latched, fully advanced position. Thus flange 52*b,* with edges 52*e* and 52*f* in abutting engagement with edges 62, will limit the amount of rotation that shaft 20 will travel.

Figure 2:
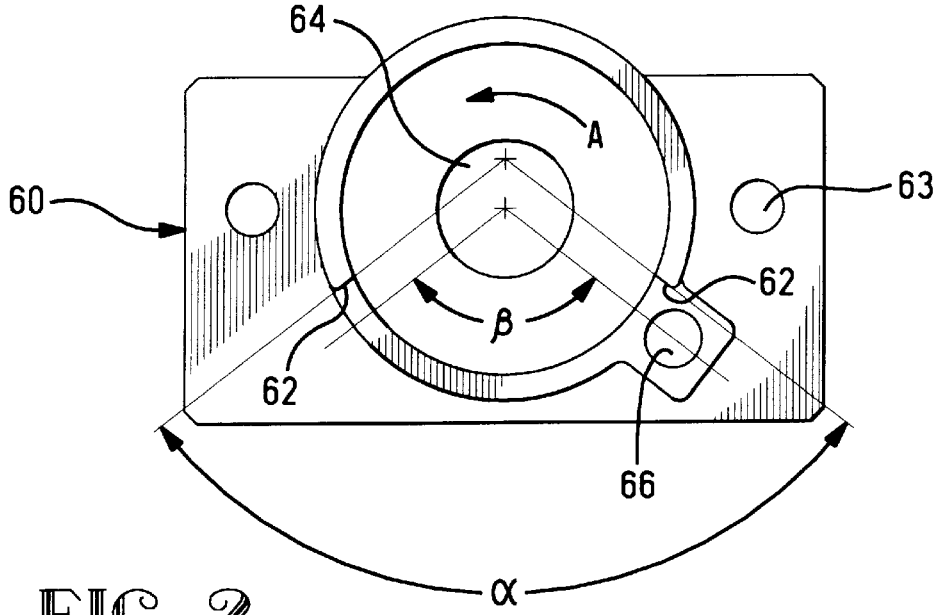
FIG. 2 shows a top view of the support member for the latch detent/stop mechanism of FIG. 1.

FIG. 2 shows the latch support 60 of FIG. 1. Latch support 60 includes the stop edges 62 which define an angle β therebetween, which angle is centered on the axis of bore 64. Angle β, an angle between lines which denote the general center of flange 52*b* at the advanced and retracted positions of shaft 20, defines the range of angular rotation of shaft 20, by virtue of stop flange 52*b* of D-slot washer 52, which flange 52*b* abuttingly engages stop edges 62. The preferred range for angle β is about 45° to 180°. Angle α indicates the angle at which stop edges 62 of latch support 60 and stop edges 52*e* and 52*f* of flange 52*b* are cut so that the stop edges 52*e* and 52*f* will be generally flush against respective stop edges 62 when the edges 52*e* and 52*f* are engaged therewith. Latch support 60 further includes bolt holes 63 for receiving fasteners therein for fastening the latch support 60 to an electrical connector frame, as will be described below.

Figure 3:
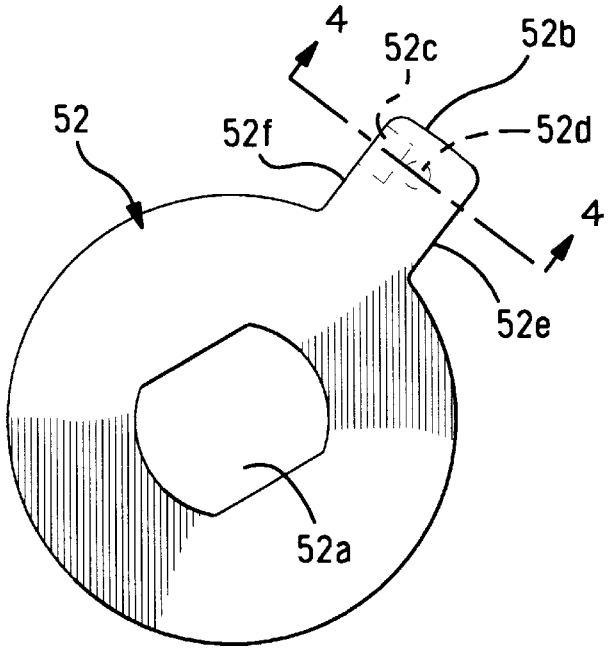
FIG. 3 shows a top view of a rotatable D-slot washer of FIG. 1.
Figure 4:
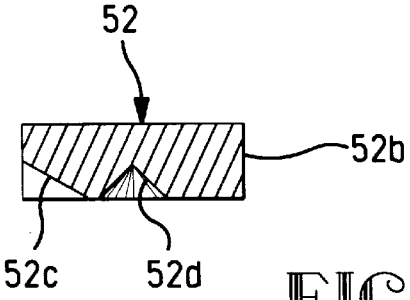
FIG. 4 is a cross sectional view of a portion of the D-slot washer of FIG. 3.

FIG. 3 shows the D-slot washer 52 with a D-slot 52*a,* stop flange 52*b* having a camming surface or ramp 52*c,* a ball receptacle 52*d* as best shown in FIG. 4, and stop edges 52*e* and 52*f*. Referring to FIG. 4, ramp 52*c* is operable to depress the ball of the ball plunger 56 when the flange 52*b* is rotated into engagement therewith in the fully retracted position of shaft 20. The ball of ball plunger 56 will be depressed by ramp 52*c,* and will be biased up into ball receptacle 52*d* of flange 52*b,* thereby making a detent for washer 52 and shaft 20 in the retracted position thereof. The flat sections of slot 52*a* of D-slot washer 52 tightly fit onto opposing key flats 21 of shaft 20 thereby interlocking with the shaft, which interlocking relationship ensures that any torque applied to, or rotational motion of, shaft 20 will be applied to D-slot washer 52 as well. Therefore, any rotation of shaft 20 about its longitudinal axis will cause concomitant rotation of D-slot washer 52 about the same axis.

Figure 5:
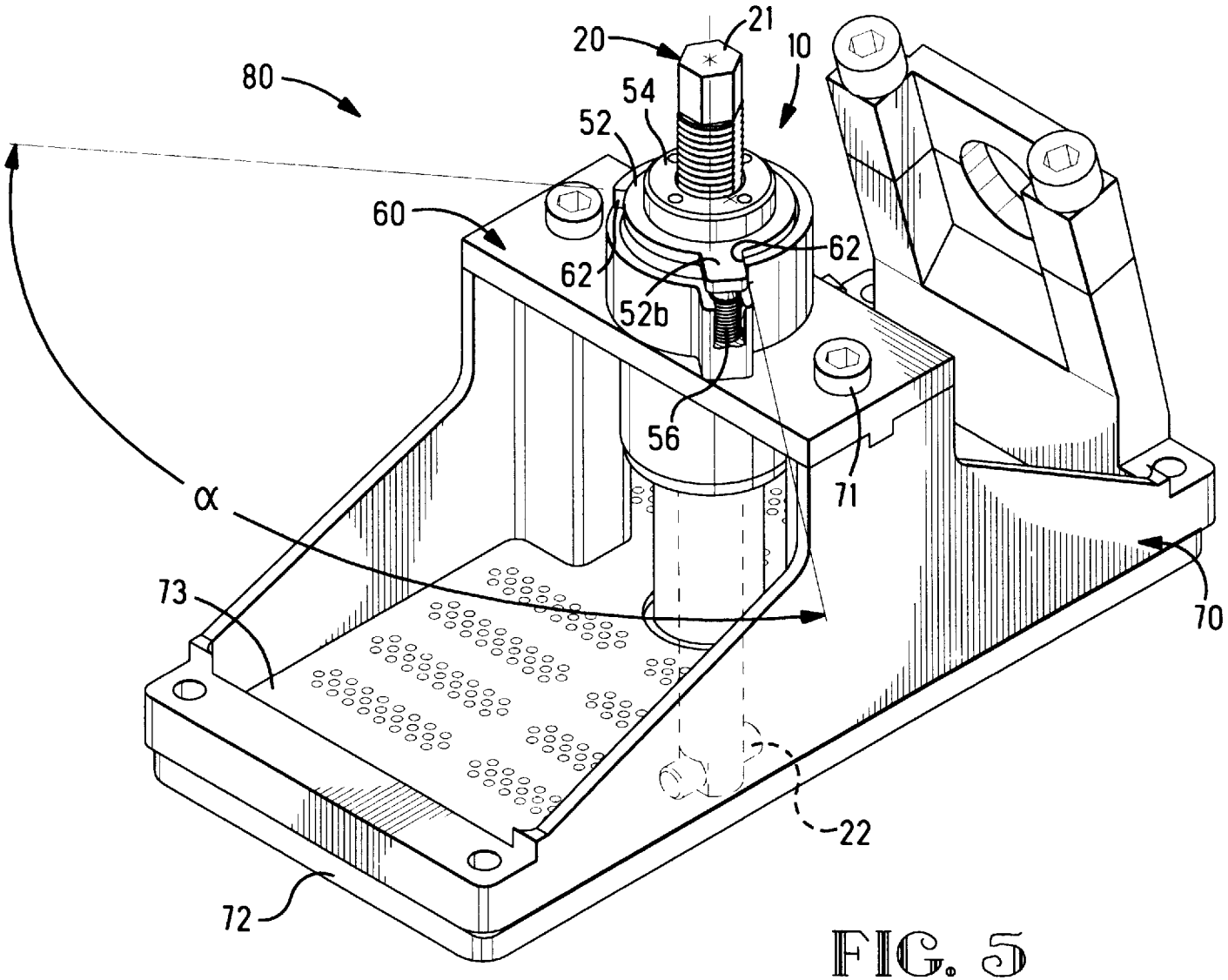
FIG. 5 is an isometric view of the latch detent/stop mechanism of FIG. 1 installed on an electrical connector frame assembly.

FIG. 5 shows an electrical subassembly 80 comprising the locking mechanism 10 of the present invention installed in a connector frame 70. Connector frame 70 includes fasteners 71 attaching the latch support 60 to the frame. Connector frame 70 further includes an electrical interface board 72, and contact apertures 73 in the interface board 72. This connector frame arrangement is like the assembly disclosed in U.S. Pat. No. 5,310,352, which is incorporated by reference. A torque force, when applied to shaft 20, will cause the shaft 20 to rotate, which causes the washer 52 to rotate, but this rotation is delimited as flange 52*b* is stopped by stop edges 62. Moreover, the position of flange 52*b* as shown in FIG. 5, requires the flange to be in engagement with the ball plunger 56 when the shaft 20 is in a fully retracted position. Therefore, the detent mechanism is activated and will maintain the shaft 20 in a fully retracted, unlatched state until a torque is applied to the shaft which is directed towards the advanced position of the shaft 20.

Figure 6:
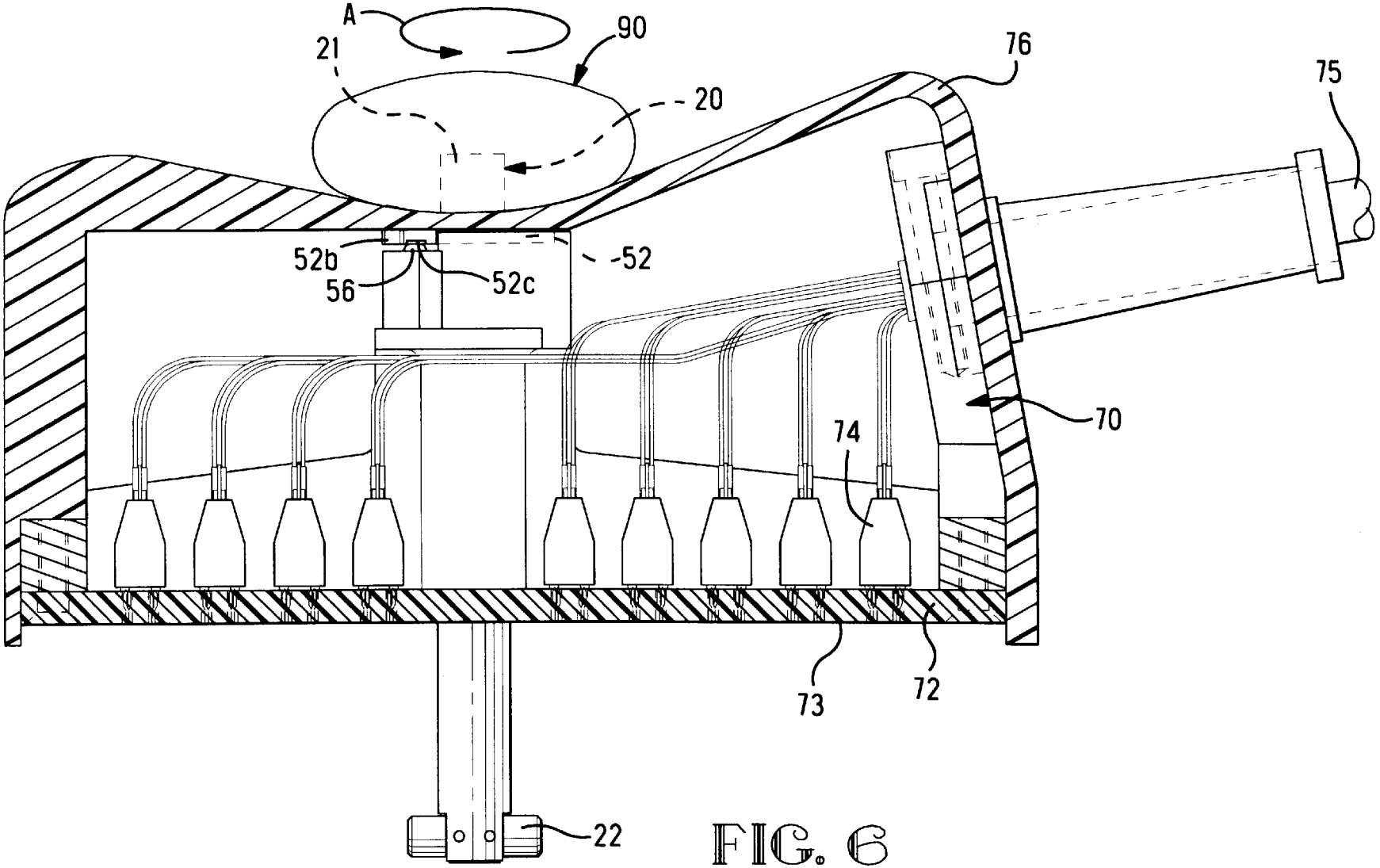
FIG. 6 shows the latch detent/stop mechanism of FIG. 1 installed in an electrical connector frame with a housing around the frame and a key positioned over the shaft.

FIG. 6 shows a cross sectional view of the locking mechanism 10 installed on a frame 70 as in FIG. 5. However, an insulative cover 76 has been placed around the connector frame 70, electrical cable 75 brings electrical conductors into the frame 70, and electrical units 74 are connected to electrical interface board 72 using electrical contacts. This electrical interface arrangement is like the electrical connector disclosed in U.S. Pat. No. 5,310,352, which is incorporated by reference hereinabove. Additionally, a key 90 is positioned over shaft 20 to apply torque to the key flats 21 thereof for causing the rotational motion of the shaft 20.

Thus, while preferred embodiments of the invention have been disclosed, it is to be understood that the invention is not to be strictly limited to such embodiments but may be otherwise variously embodied and practiced within the scope of the appended claims. Although a key is used to apply torque to the shaft, it is expected that the shaft can be modified by skilled artisans to receive other torque applying tools or their equivalents, without departing from the scope of the appended claims, for example: screw drivers; wrenches; power-operated tools; and robotic or human hands or fingers.

Accordingly, what is claimed is:

1. An electrical connector, comprising:

an assembly with at least one electrical contact therein, and a locking mechanism operatively attached to said assembly;

said locking mechanism comprises a rotatable shaft for locking said electrical connector to a further electrical connector, and said shaft has a longitudinal shaft axis; and said locking mechanism further comprises a stop mechanism operatively connected to said locking mechanism, and said stop mechanism limits rotation of the shaft about the shaft axis, said stop mechanism comprises a washer with a tab extending therefrom, and said locking mechanism further comprises a spring member biasingly supporting the shaft to the assembly.

2. The electrical connector of claim 1, wherein the stop member comprises a disc-shaped member.

3. The electrical connector of claim 2, wherein the disc-shaped member comprises a D-slot washer.

4. The electrical connector of claim 1, wherein a portion of the stop mechanism is engageable with a portion of the locking mechanism thereby limiting the rotation of the shaft.

5. The electrical connector of claim 4, wherein said portion of the stop mechanism which engages a portion of the locking mechanism comprises an extension of said stop mechanism.

6. The electrical connector of claim 5, wherein said extension comprises a camming surface.

7. The electrical connector of claim 5, wherein said extension comprises a detent receptacle.

8. The electrical connector of claim 4, wherein said portion of the stop mechanism which engages a portion of the locking mechanism comprises a rigid member.

9. The electrical connector of claim 1, wherein said shaft includes a tool receiving section, and said stop mechanism is located adjacent to said tool receiving section along a portion of said shaft.

10. The electrical connector of claim 1, wherein said shaft includes a stop mechanism receiving section.

11. The electrical connector of claim 10, wherein said receiving section passes through a portion of said stop mechanism.

12. The electrical connector of claim 10, wherein said receiving section is interlocked with a portion of said stop mechanism.

13. The electrical connector of claim 10, wherein said shaft receiving section comprises a solid portion of said shaft.

14. The electrical connector of claim 1, wherein said locking mechanism is supported by a latch support having stop edges formed thereon.

15. The electrical connector of claim 14, wherein said stop edges are engageable with a portion of said stop mechanism thereby limiting the range of rotation of the shaft about its axis, which range is defined by an angle β about said axis.

16. An electrical connector, comprising:

an assembly with at least one electrical contact therein, and a locking mechanism operatively attached to said assembly;

said locking mechanism comprises a rotatable shaft for locking said electrical connector to a further electrical connector, and said shaft has a longitudinal shaft axis; and said locking mechanism further comprises a detent mechanism operatively connected to said locking mechanism, and said detent mechanism retains the shaft in a position about the shaft axis, said detent mechanism comprises a washer with a tab extending therefrom, and said locking mechanism further comprises a spring member biasingly supporting the shaft to the assembly.

17. The electrical connector of claim 16, wherein the detent mechanism comprises a disc-shaped member.

18. The electrical connector of claim 17, wherein the disc-shaped member comprises a D-slot washer.

19. The electrical connector of claim 16, wherein a rotatable portion of the detent mechanism is engageable with a detent member of said detent mechanism.

20. The electrical connector of claim 19, wherein said rotatable portion of the detent mechanism comprises an extension.

21. The electrical connector of claim 20, wherein said extension comprises a camming surface for camming engagement with said detent member.

22. The electrical connector of claim 20, wherein said extension comprises a detent member receptacle.

23. The electrical connector of claim 19, wherein said rotatable portion of the detent mechanism comprises a rigid member.

24. The electrical connector of claim 16, wherein said shaft includes a tool receiving section and said detent mechanism is located adjacent to said tool receiving section along a portion of said shaft.

25. The electrical connector of claim 16, wherein said shaft includes a detent mechanism receiving section.

26. The electrical connector of claim 25, wherein said shaft detent mechanism receiving section passes through a portion of said detent mechanism.

27. The electrical connector of claim 25, wherein said shaft receiving section is interlocked with a portion of said detent mechanism.

28. The electrical connector of claim 25, wherein said shaft receiving section comprises a solid shaft portion.

29. The electrical connector of claim 16, wherein said locking mechanism is supported by a latch support having a detent member receiving chamber formed therein.

30. The electrical connector of claim 29, wherein said chamber has a detent member disposed therein which is engageable with a rotatable portion of said detent mechanism thereby retaining the shaft in a position about the shaft axis.

31. An electrical connector, comprising:

an assembly with at least one electrical contact therein, and a locking mechanism operatively attached to said assembly;

said locking mechanism comprises a rotatable shaft for locking said electrical connector to a further electrical connector, and said shaft has a longitudinal shaft axis;

said locking mechanism comprises a combination detent/stop mechanism operatively connected to said locking mechanism, said detent/stop mechanism is operable to retain the shaft in a position about the shaft axis and to limit rotation of the shaft about its axis, said detent/stop mechanism comprises a washer, and said locking mechanism further comprises a spring member biasingly supporting the shaft to the assembly.

32. The electrical connector of claim 31, wherein said detent/stop mechanism comprises a detent member located radially away from said shaft.

33. The electrical connector of claim 31, wherein said detent/stop mechanism comprises a rotatable actuation member.

34. The electrical connector of claim 33, wherein said actuation member comprises a camming surface for engaging a detent member.

35. The electrical connector of claim 33, wherein said actuation member comprises a rotatable stop surface for engaging a relatively stationary stop surface.

36. The electrical connector of claim 33, wherein said actuation member comprises a flange.

37. The electrical connector of claim 33, wherein said actuation member comprises interlocking surfaces which interlock with surfaces on said shaft.

38. The electrical connector of claim 33, wherein said actuation member comprises a generally disc-shaped member.

39. An electrical connector, comprising:

an assembly with at least one electrical contact therein, and a locking mechanism operatively attached to said assembly;

said locking mechanism comprises a rotatable shaft for locking said electrical connector to a further electrical connector, and said shaft has a longitudinal shaft axis; and said locking mechanism further comprises a stop mechanism operatively connected to said locking mechanism, and said stop mechanism limits rotation of the shaft about the shaft axis, the stop mechanism comprises a D-slot washer.

40. An electrical connector, comprising:

an assembly with at least one electrical contact therein, and a locking mechanism operatively attached to said assembly;

said locking mechanism comprises a rotatable shaft for locking said electrical connector to a further electrical connector, and said shaft has a longitudinal shaft axis; and said locking mechanism further comprises a detent mechanism operatively connected to said locking mechanism, and said detent mechanism retains the shaft in a position about the shaft axis, the detent mechanism comprises a D-slot washer.

* * * * *